United States Patent [19]

Ogawa

[11] Patent Number: 5,003,900

[45] Date of Patent: Apr. 2, 1991

[54] THREAD SECURING DEVICE IN A SEWING MACHINE

[75] Inventor: Masao Ogawa, Nagoya, Japan

[73] Assignee: Brother Kogyo Kabushiki Kaisha, Nagoya, Japan

[21] Appl. No.: 342,696

[22] Filed: Apr. 21, 1989

Related U.S. Application Data

[63] Continuation of Ser. No. 84,697, Aug. 11, 1987, abandoned.

[30] Foreign Application Priority Data

Aug. 12, 1986 [JP] Japan ..... 61-190269

[51] Int. Cl.[5] ..... D05B 49/00; D05B 87/00

[52] U.S. Cl. ..... 112/242; 112/225; 112/255

[58] Field of Search ..... 112/225, 242, 243, 255, 112/302

[56] References Cited

U.S. PATENT DOCUMENTS 4,215,641 8/1980 Dobrjanskyj ..... 112/302 X
4,590,879 5/1986 Matsubara et al. ..... 112/242 X
4,651,660 3/1987 Oshima et al. ..... 112/225
4,688,501 8/1987 Mikuni et al. ..... 112/241
4,766,827 8/1988 Matsubara ..... 112/242 X

*Primary Examiner*—Wm. Carter Reynolds
*Attorney, Agent, or Firm*—Koda and Androlia

[57] ABSTRACT

A thread securing device in a sewing machine wherein an upper thread located along a thread guiding path is caught during the travel of a thread take-up member to effect automatic hooking of the thread thereto. The thread securing device includes a thread saving member capable of saving an amount of the upper thread corresponding to a predetermined amount of the upper thread to be taken up by the thread take-up member during its movement from a thread loosening position to a thread take-up position, and capable of feeding the saved amount of the upper thread freely in accordance with the thread take-up movement of the thread take-up member; and an actuating member adapted to catch the upper thread extending along the thread guiding path when the thread take-up member is not holding the upper thread and then supply an amount of the upper thread corresponding to the predetermined amount, to the thread saving member.

3 Claims, 16 Drawing Sheets

THREAD SECURING DEVICE IN A SEWING MACHINE

This is a continuation of application Ser. No. 084,697 filed Aug. 11, 1987, now abandoned

BACKGROUND OF THE INVENTION

1. Field of the Invention

The present invention relates to a thread securing device in a sewing machine, more particularly to a thread securing device in a sewing machine wherein an upper thread located along a thread guiding path is caught during the travel of a thread take-up lever to effect automatic hooking of the thread thereto, the upper thread being secured preliminarily corresponding to the take-up amount thereof taken by the thread take-up lever so as to effectively prevent slipping off of the upper thread from the thread eye of the needle upon starting up of the sewing machine.

2. Description of the Prior Art

In sewing work fabric with a sewing machine, a thread loop to be formed in a short ascending stroke of a needle having been pierced through the fabric is adapted to be caught by the tapered hook of a shuttle in an appropriate timing. After catching of the thread loop, the upper thread has to be pulled up abruptly to release the thread loop from the tapered hook, and a thread take-up member (commonly referred to as "thread take-up lever"; the same shall be used hereinafter) is used for the above purpose. As such type of thread take-up lever, a structure is widely used wherein a link mechanism or a cylindrical cam is employed to impart a vertical arcuate orbital movement to the thread take-up lever. An operation of hooking the thread into a thread holding end of the thread take-up lever is also included in a series of operations in preparation for starting a sewing operation to extend an upper thread drawn from a spool in a predetermined order and to finally thread it into the thread eye of a needle.

The above-described thread extending operation in preparation for sewing operation using a sewing machine is generally complicated because of its complicated thread guiding path and extending order. For such reasons, various mechanisms have been proposed which can effect thread extending and threading operations automatically and are also practically utilized. The Japanese Utility Model Publication No. 43878/1979, for example, discloses a device which effects automatic threading of an upper thread into the thread eye of a needle as a suggestion made by the assignee of the present application.

There have also been suggested devices to effect automatic hooking of a thread into a thread take-up lever, for example, as in the "sewing machine" also disclosed in the Japanese Utility Model Publication No. 151681/1986 (withdrawn) filed by the assignee of the present application. In this invention, the sewing machine is constructed such that an upper thread Y, having been extended by a thread hooking member 14 during a cycle of horizontal reciprocating stroke of a thread holding end 24 of a thread take-up device in effecting thread hooking, is threaded into a thread holding hole 29 of the thread holding end 24, and under the same state, an automatic take-up of the upper thread Y is effected as the thread holding end reciprocates horizontally.

A sewing machine provided with a mechanism which effects hooking of a thread automatically into the thread holding end of the thread take-up lever as described above can be highly evaluated in that it can simplify the complicated thread hooking operation and that it has achieved an improved operability by a beginner. However, such a type of sewing machine suffers problem that a thread having been threaded into the thread eye of the needle retracts from the thread eye when the thread holding end of the thread take-up lever catches and takes up the upper thread in accordance with the movement of the thread take-up lever and to finally slip off the thread eye if the amount of thread to be taken up thereby exceeds the quantity of thread having been threaded into the thread eye and extending outward therefrom.

In such a case, an operation must be repeated to thread the upper thread into the thread eye of the needle after completion of the automatic thread hooking to the thread take-up lever, or care must be taken to pull out a sufficient amount of the upper thread manually extending out of the needle in order to prevent occurrence of the above slipping off of thread. The above operations are extremely complicated and there was hoped a device having overcome such disadvantages.

SUMMARY OF THE INVENTION

It is, accordingly, a principal object of the present invention to provide a thread securing device in a sewing machine which can effectively prevent the upper thread having been threaded into the thread eye of a needle from slipping off therefrom during the automatic thread hooking operation of the thread take-up lever.

In an attempt to overcome the above problems and achieve the above objects suitably, the invention provides a thread securing device in a sewing machine having a thread source, a needle having a thread eye to which an upper thread extends from the thread source, a thread take-up member adapted to move in timed relation to the vertical movement of the needle between a thread loosening position close to a predetermined thread guiding path extending from the thread source to the thread eye of the needle and a thread take-up position spaced away from the thread guiding path, the thread take-up member being operative to catch and hold the upper thread extending along the thread guiding path when the thread take-up member first approaches in the vicinity of the thread loosening position. The thread securing device comprises a thread saving member capable of saving an amount of the upper thread corresponding to a predetermined amount of the upper thread to be taken up by the thread take-up member during its movement from the thread loosening position to the thread take-up position, and capable of feeding the saved amount of the upper thread freely in accordance with the thread take-up movement of the thread take-up member; and an actuating member adapted to catch the upper thread extending along the thread guiding path when the thread take-up member is not holding the upper thread and then supply an amount of the upper thread corresponding to the predetermined amount, to the thread saving member.

According to the thread securing device in a sewing machine thus constructed, a hook-shaped transfer body provided at the tip of the actuating member is actuated, prior to the catching of an upper thread by a thread take-up means (thread take-up lever), to catch the upper thread located along the thread guiding path and supply an amount of thread to a thread saving member corresponding to the amount of thread to be taken up by the thread take-up member during its operation.

Figure 8:
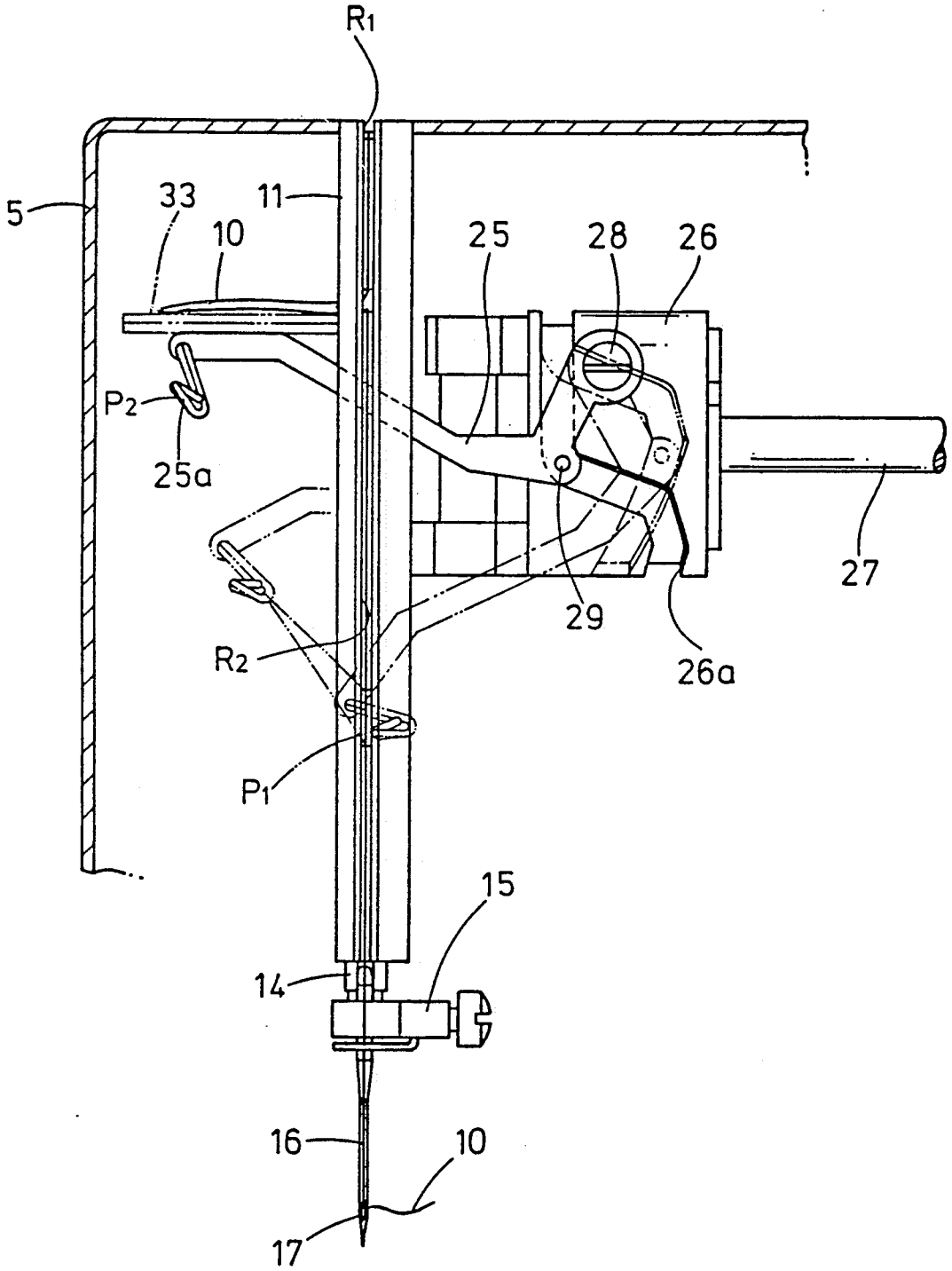
Figure 9:
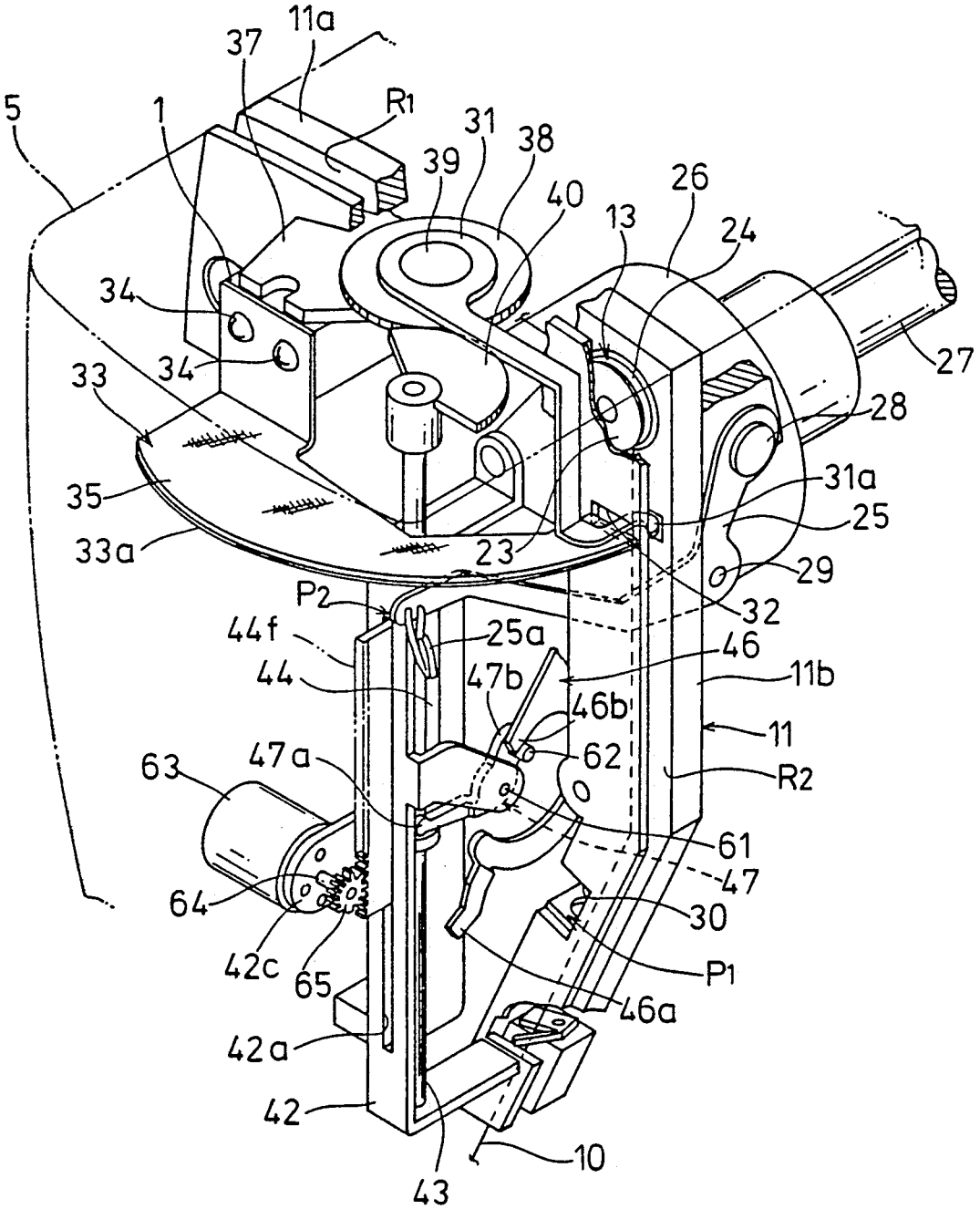
Figure 10:
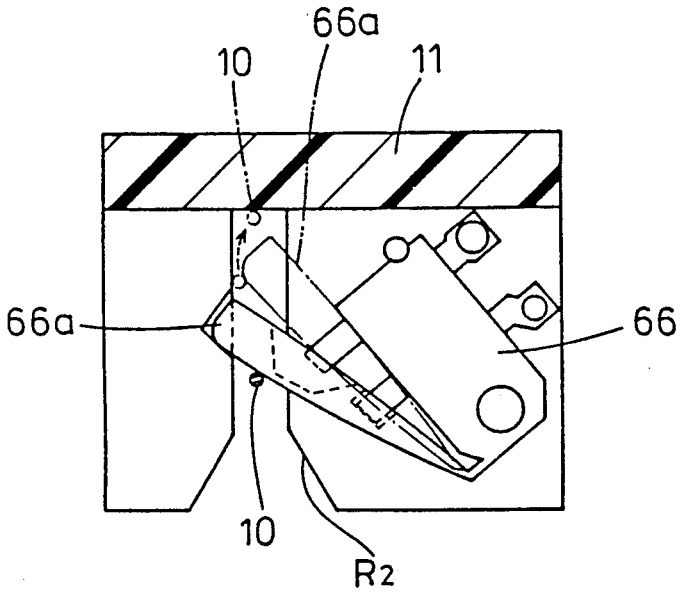
Figure 11:
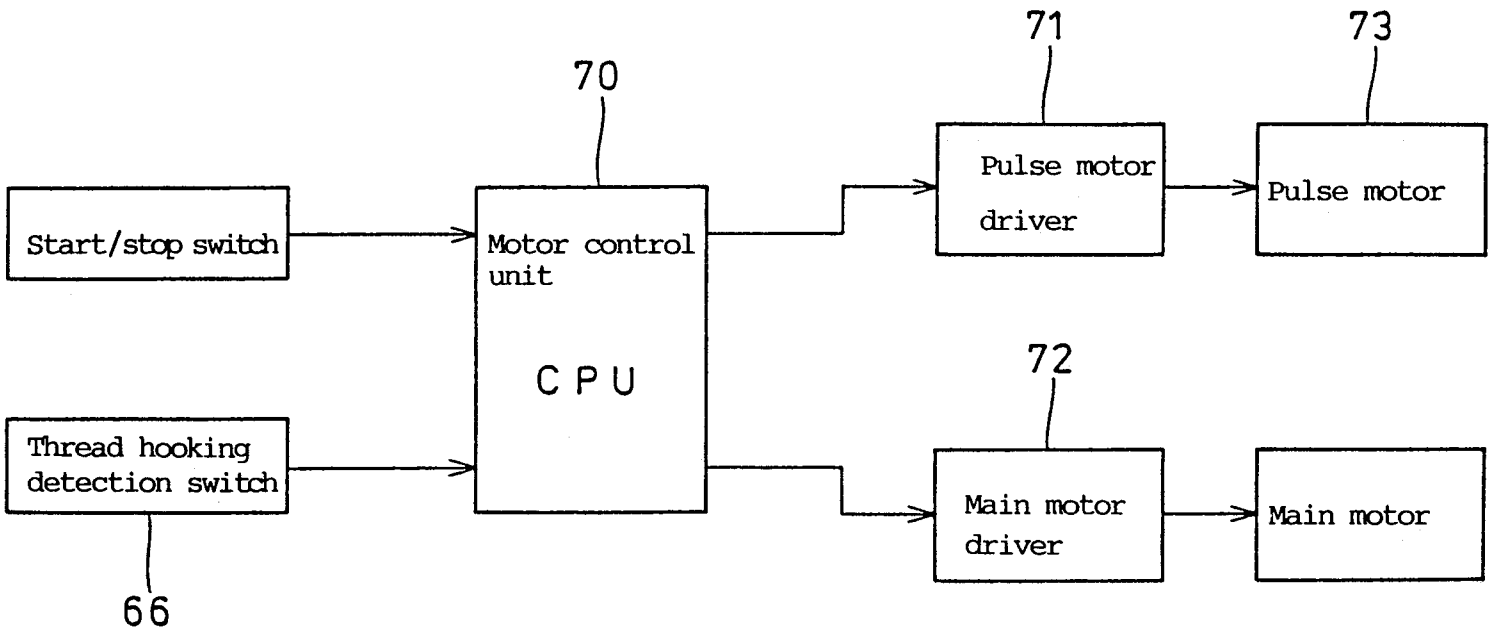

FIGS. *7a* to *7e* are schematic illustration of the operation process of the actuating member to be actuated by the handling of the operation member and the biasing member which interlocks with the thread tension regulator, respectively, with passage of time;

FIG. 8 is a schematic illustration of the vertical movement of the thread take-up lever;

FIG. 9 is a schematic perspective view of the thread securing device according to another embodiment;

FIG. 10 is a layout of an example of the detector arranged in the thread guiding path;

FIG. 11 is a block chart of the control circuit of the sewing machine; and

Figure 12:
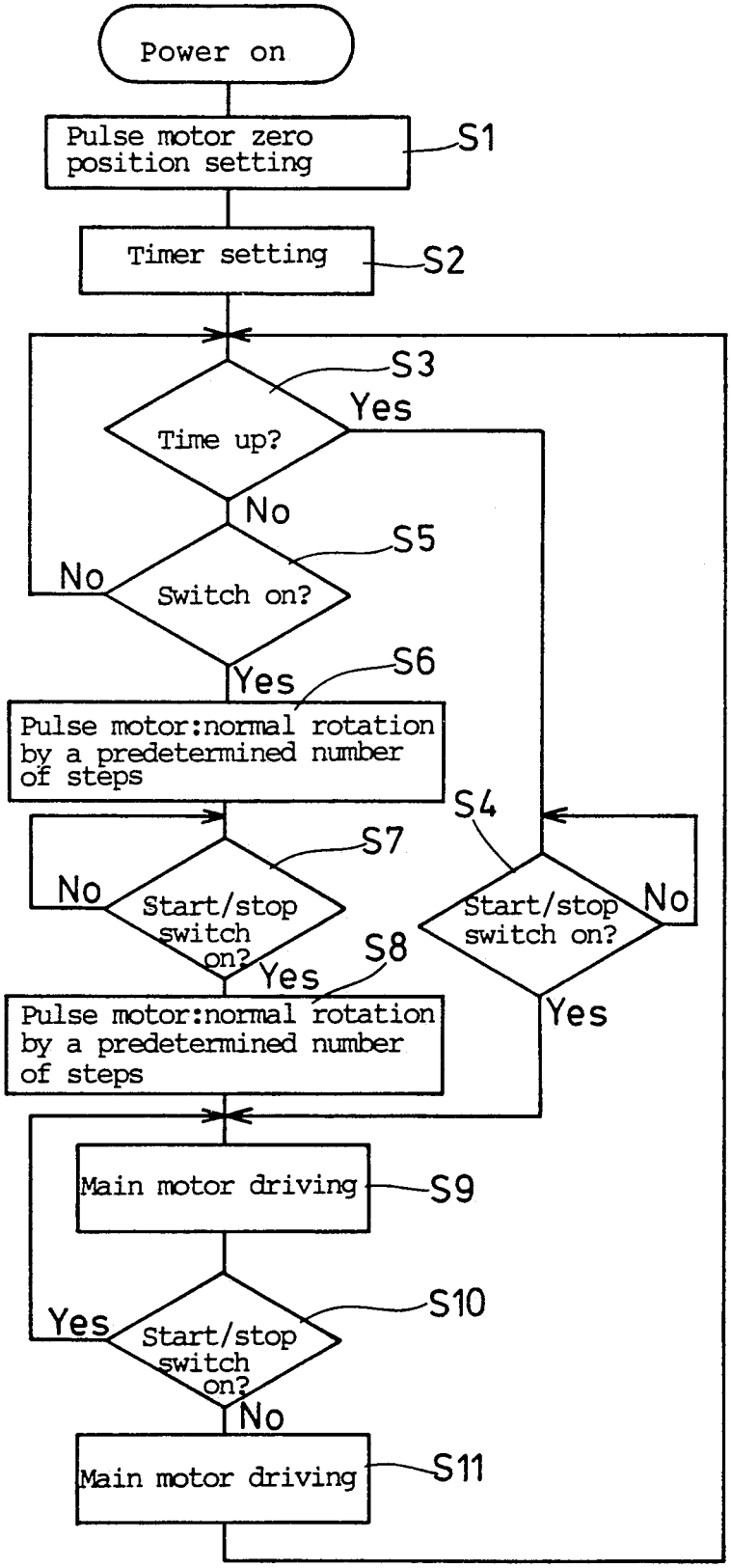

FIG. 12 is a flow chart in starting up the sewing machine of FIG. 9.

DESCRIPTION OF THE PREFERRED EMBODIMENTS

The thread securing device in a sewing machine according to the present invention will be described below by way of a preferred embodiment referring to the attached drawings. It should be understood that the sewing machine in which the present invention is practiced should not necessarily be provided with a threading device which can thread an upper thread automatically into the thread eye of a needle and can be used as such suitably; however, the sewing machine according to the embodiment as shown in FIGS. 1 to 8 will be illustrated as provided with said threading device.

Figure 1:
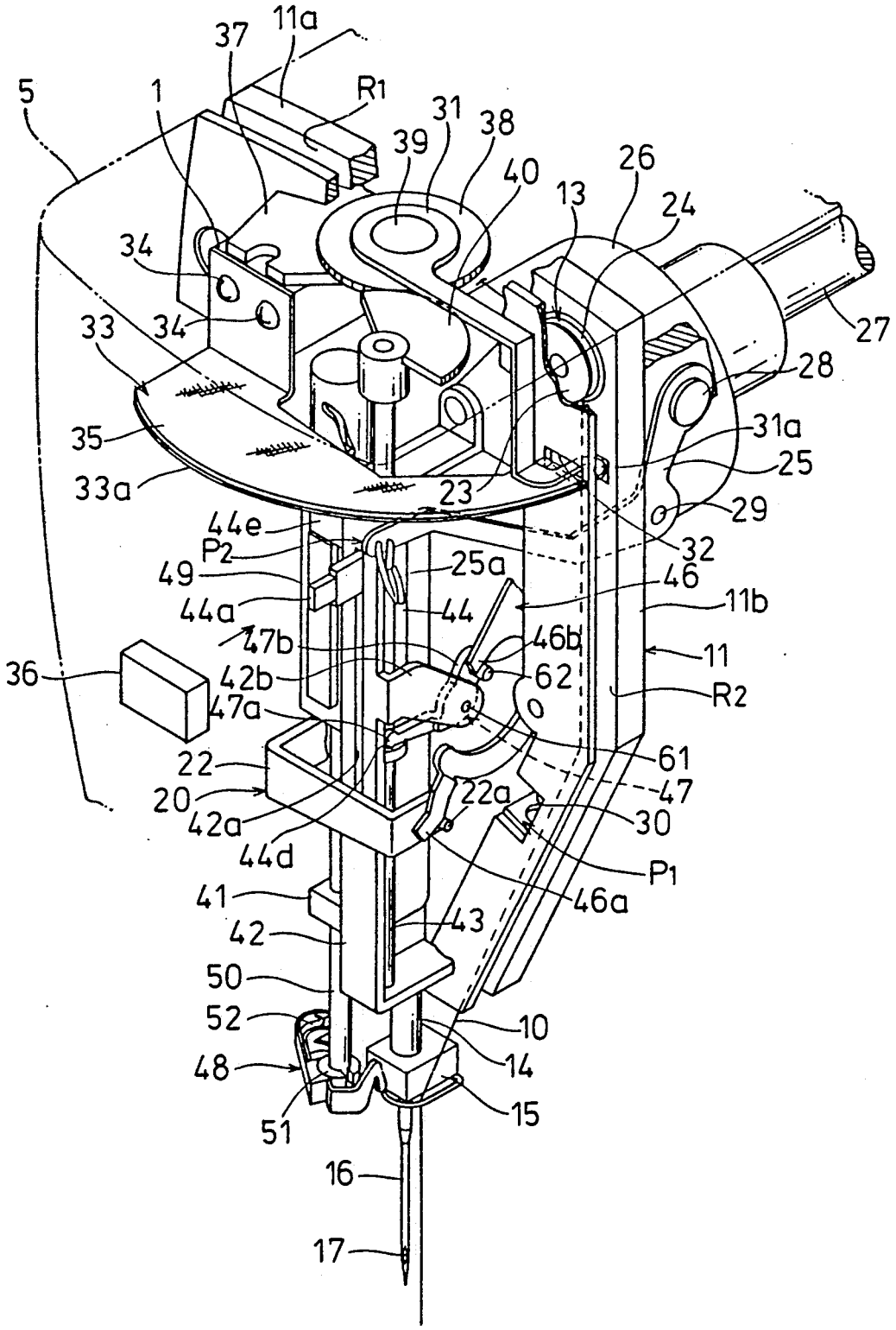
FIG. 1 is a perspective view of an embodiment of the present thread securing device schematically showing its structure as built in the head of a sewing machine.
Figure 2:
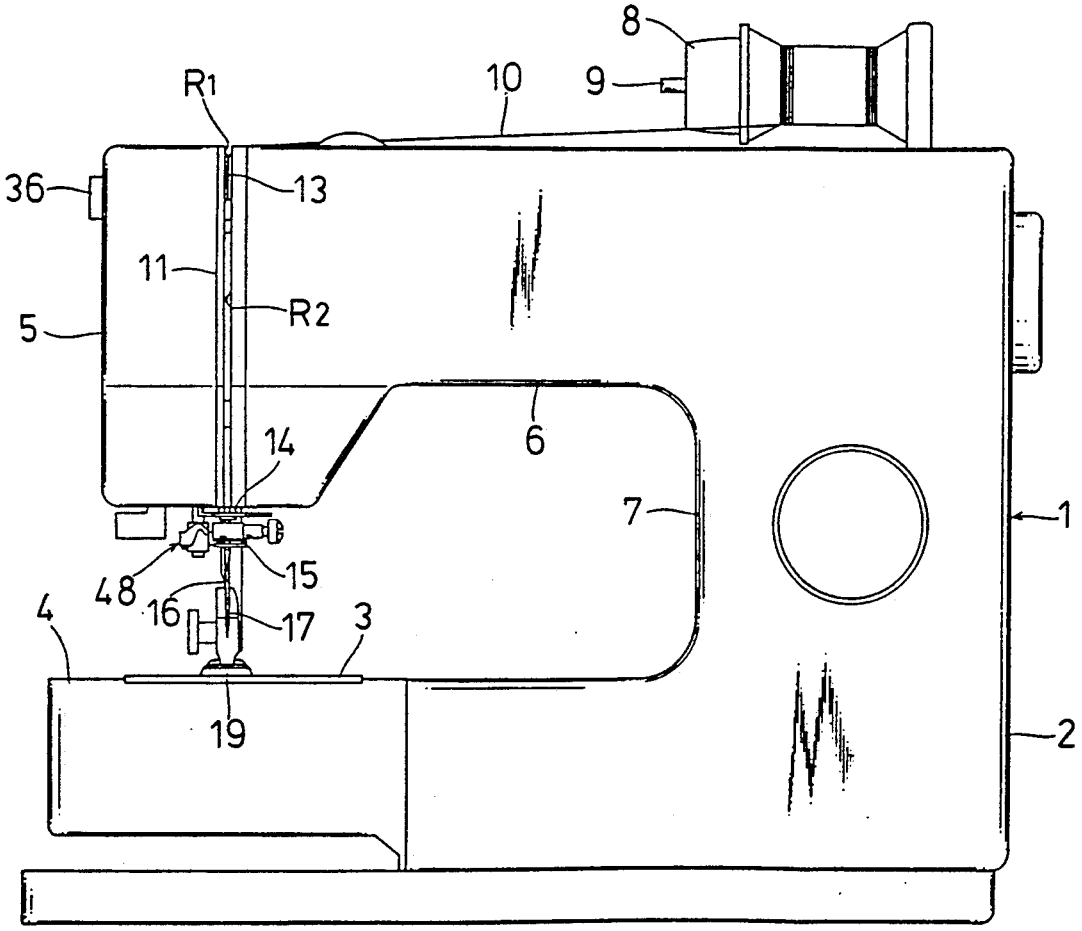
FIG. 2 is a front view showing an overall appearance and arrangement of the sewing machine in which the thread securing device may be practiced.
Figure 3:
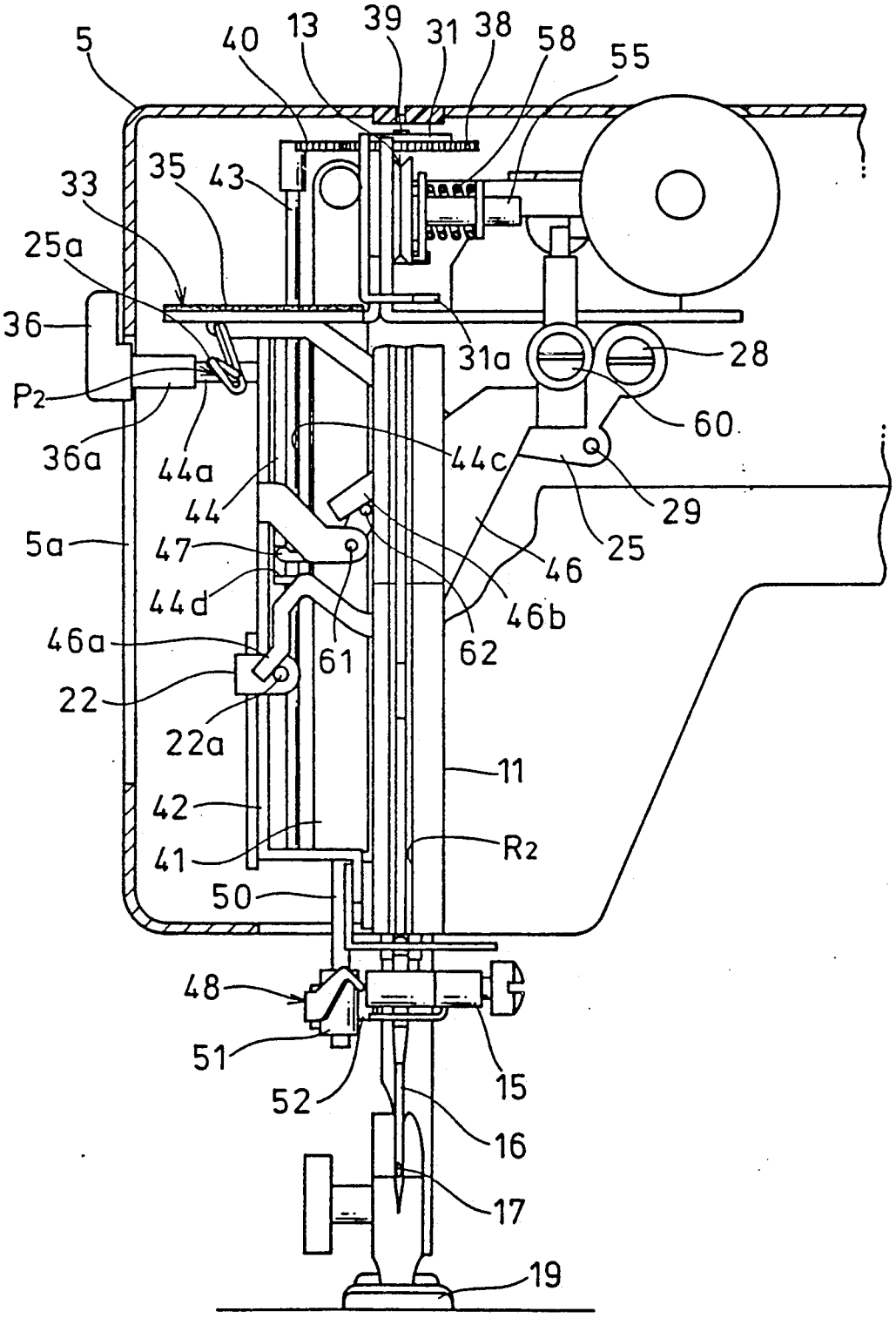
FIG. 3 is an enlarged partially cutaway view of the head of the sewing machine shown in FIG. 2.

FIG. 1 shows a schematic perspective view of the thread securing device according to a preferred embodiment of the invention, as built in the head of the sewing machine; FIG. 2 shows a front view illustrating an overall appearance and arrangement of the sewing machine in which the thread securing device may be practiced; FIG. 3 shows an enlarged partially cutaway view of the head of the sewing machine shown in FIG. 2; and FIG. 4 shows a left side view of the head of the sewing machine shown in FIG. 2 with the cover thereof removed.

Basic Construction of the Sewing Machine

Referring particularly FIG. 2, a main frame 1 is basically formed of a base 2; a lower arm (bed) 4 extending horizontally from the base 2 and having a needle plate 3 on the upper surface; an upper arm 6 (bracket) extending horizontally above and parallel to the lower arm 4 and provided with a head 5 at the end portion; and a standard 7 which combines the arms 4 and 6 to form an integral unit, and a combination of a hard synthetic resin and a diecast alloy is used as the materials therefor with a view to reducing its weight. At the top of the upper arm 6, a spool 8 as a thread source is supported by a horizontal pin 9; and a thread to be used as the upper thread 10 drawn from the spool 8 is diverted through a thread guide (not shown) to change the direction from which the thread is drawn. The upper thread 10 is then inserted in a horizontal groove R1 formed in a thread guiding path defining plate 11 to be described later, and further into a thread tension regulator 13 (described later) to permit support of the thread therebetween under press contact. The upper thread 10 passed through the thread tension regulator 13 is inserted to the vertical groove R2 in the defining plate 11 and finally to the thread eye 17 of the needle 16 attached by means of a needle clamp 15 to the lower end of a needle bar 14.

Figure 4:
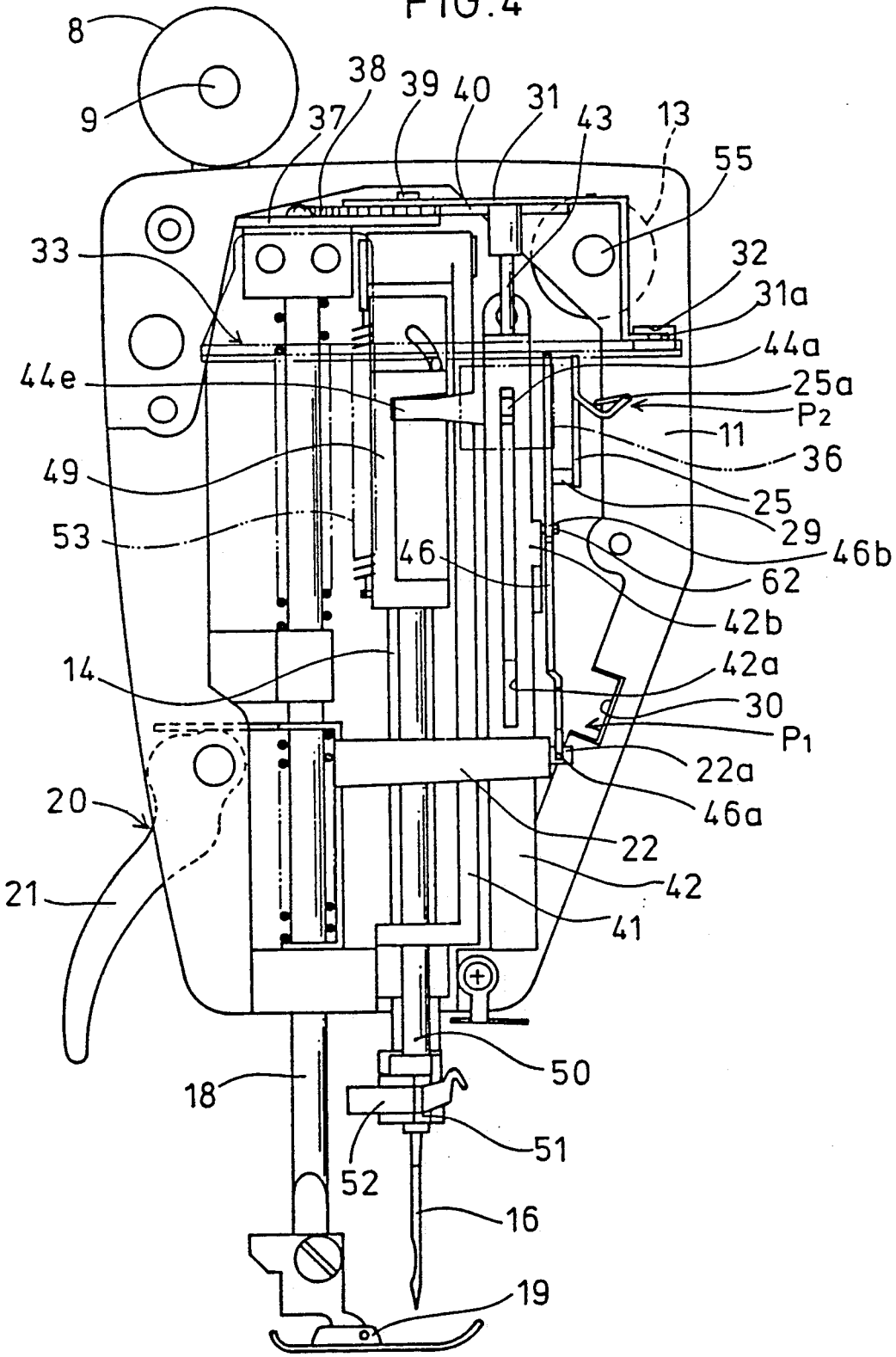
FIG. 4 is a left side view of the head of the sewing machine shown in FIG. 2 with the cover thereof removed.

Also as shown in FIG. 4, a presser foot 19 is provided at the lower end of the presser bar 18 such that the presser bar 18 may be lifted up and down by means of a knee lifter lifting lever 21 and a link member 22 constituting a presser bar lifter 20. It should be noted that the presser bar lifter 20 is adapted to release the press contact between the two tension discs 23 and 24 in the thread tension regulator 13 through an interlocking mechanism to be described later during the lifting operation of the presser foot.

Tread Take-up Lever

In FIGS. 1 and 8, the element shown with the numeral 25 is intended for taking up the upper thread 10 to tighten a loop to be formed during the ascending stroke of the needle 16 in sewing fabric as described above, after the loop is caught by the tapered hook of a shuttle. And a cylindrical cam 26 is employed as a drive mechanism therefor. Namely, the cylindrical cam 26 is connected to one end of a main shaft 27 to be driven and rotated by a main motor (not shown), and the cylindrical cam 26 is provided around its peripheral surface with a cam groove **26*a*** having a pattern to be determined from the required cam design.

One end of the thread take-up lever 25 having a shape of an arm which bends as shown in FIG. 8 is pivoted through a pivot 28 onto the main frame 1 adjacent to the cylindrical cam 26 in the head 5. The thread take-up lever 25, as shown in FIG. 8, is adapted to oscillate vertically from the approximately horizontal position (thread take-up position P2) to a position obliquely lower by about 30° in terms of central angle (thread loosening position P1). Namely, a cam follower 29 protrudes from the bent portion of the thread take-up lever 25 and extends horizontally with the pivot 28, and the cam follower 29 is slidably inserted into the cam groove **26*a* of the cylindrical cam 26 to be imparted with vertical movement within the required central angle around the pivot 28 according to the rotation of the cylindrical cam 26. The other end of the thread take-up lever 25 is provided with a hook-shaped thread holding end 25*a*, and the thread holding end 25*a* moves along an arcuate orbit between the thread loosening position P1 adjacent to the thread guiding path to be defined by the thread guiding path defining plate 11 as shown in FIG. 1 and the thread take-up position P2 spaced away from the thread guiding path as shown in FIG. 8 in timed relation to the vertical movement of the needle bar 14 clamped to the main shaft 27**.

The thread guiding path defining plate 11 is composed of an ABS resin plate member having the outer shape which is identical with the outer vertical contour of the head 5 as shown in FIGS. 1 and 2, and comprises a horizontally extending portion 11*a* to form the top portion and a vertically extending portion 11*b* to form one of the side portions thereof. A horizontal groove R1 and a vertical groove R2 are provided around the periphery of the horizontally extending portion 11*a* and the vertically extending portion 11*b* of the defining plate 11, respectively, to define a thread guiding path; and both grooves communicate with each other at the right shoulder portion in FIG. 1. The vertically extending portion 11*b* bends slightly inward around its center directing toward the needle 16, and a recess 30 having a shape as shown in FIG. 1 is notched adjacent to the bent portion. The recess 30 is located at the thread loosening position Pl (i.e. also in the orbit along the movement of the thread take-up lever 25) in the thread guiding path extending along the vertical groove R2 and is adapted to catch the upper thread 10 when the thread holding end 25*a* first reaches the inside of the recess 30 after starting up of the sewing machine and hold the thread as shown in FIG. 8.

A thread tension regulator 13 to be described later is interposed on the right shoulder of the thread guiding path defining plate 11 as shown in FIG. 1, and a slot 32 is provided in the upper part of the vertically extending portion 11*b* of the defining plate 11 through which a transfer body 31*a* of an actuating member 31 to be described later is inserted to be retractable therefrom horizontally. It should be understood while the defining plate 11 has been described as provided with a horizontal groove R1 and a vertical groove R2 on the periphery of a piece of plate material, it may be composed of two pieces of plate materials of a similar shape combined with a required space.

Thread Saving Member

In FIGS. 1, 3 and 4, the numeral 33 designates a thread saving member for saving a required amount of the upper thread 10 prior to the thread hooking action of the thread take-up lever 25. The thread saving member 33 is composed basically of a semicircular metal plate material, and arranged horizontally and fixed onto the main frame 1 located in the upper portion of the head 5 by means of a bolt 34. The thread saving member 33 has an arcuate surface 33*a* slightly larger than the arcuate orbit drawn by a transfer body 31*a* formed at the top of the actuating member to be described later during its horizontal turning; and one starting end of the arcuate surface 33*a* is positioned adjacent to and slightly below the slot 32 provided in the vertically extending portion 11*b* of the defining plate 11. A non-slip mat 35 such as of sponge is bonded onto the upper horizontal surface of the thread saving member 33; and the transfer body 31*a* of the actuating member 31 to be described later is adapted to travel pivotally slightly above the mat.

Actuating Member

The actuating member 31 shown in FIGS. 1 and 7*a* to 7*e* serves to catch the upper thread 10 extending along the thread guiding path of said defining plate 11 when the thread take-up lever 25 is not holding the upper thread 10, to draw out a predetermined amount of the thread and to supply it to the thread saving member 33, and is adapted to turn horizontally with a required central angle by operating an operating member 36 to be described later. Specifically, a support plate 37 is fixed horizontally on the upper surface of the main frame 1 located in the upper part of the head 5, and a gear 38 and one end of the actuating member 31 which have been coaxially fixed are pivoted onto the support plate 37 by means of a vertical shaft 39 to permit horizontal turning thereof. The actuating member 31 is composed of an arm-shaped platelet bent in the form of Z, and a hook-shaped transfer body 31*a* to catch the upper thread 10 is formed at the other end thereof. The transfer body 31*a* is adapted to turn horizontally slightly above the mat 35 of the thread saving member 33 as described above.

The actuating member 31 is caused to turn horizontally with a required central angle by turning a sector form gear 40 which engages the gear 38 coaxially fixed with the actuating member 31. Namely, as shown in FIGS. 1, 3 and 4, a U-shaped shaft supporting frame 42 is provided in parallel relation to a needle bar supporting block 41 which supports a needle bar 14 for vertical movement and the upper and the lower ends of the U-shaped shaft supporting frame 42 are fixed to the main frame 1 by means of a bolt, respectively. A guide slit 42*a* of a required length is provided on the vertical surface of the shaft supporting frame 42, and a pivotal shaft 43 is pivoted vertically through the upper and lower portions extending horizontally and parallel to each other from the respective curved portions. The sector form gear 40 is mounted on the upper and of the pivotal shaft 43 such that the former may engage the gear 38.

As shown in FIG. 3 and particularly in FIG. 7, the pivotal shaft 43 is fitted therearound with a resin cylindrical slider 44 slidably in the longitudinal direction of the shaft, and a connecting piece 44*a* formed integrally with slider 44 is inserted to the guide slit 42*a* of the shaft supporting frame 42 and protrudes horizontally therefrom. A spiral slit 44*b* is formed along the periphery of the slider 44, and a pin 45 protruding from the pivotal shaft 43 is inserted to this slit 44*b*. As shown in FIG. 3, a rear face projection 36*a* of an operating member 36 of a shape shown in FIG. 3 extends through the vertical slit 5*a* provided on the left side of the head 5, and the projection 36*a* is connected through fitting to the connecting piece 44*a* of the slider 44. Accordingly, by pushing down the operating member 36 along the slit 5*a* from the outside of the head 5, the slider 44 descends vertically guided by the guide slit 42*a* formed in the shaft supporting frame 42, and as this occurs, the pin 45 inserted to the spiral slit 44*b* is pushed to impart counterclockwise turning to the pivotal shaft 43. It will be understood that the turning of the pivotal shaft 43 in turn imparts clockwise turning to the gear 38 engaged by the sector form gear 40, thereby to turn the actuating member 31 and the transfer body 31*a*. However, the spiral slit 44*b* provided in the slider 44 is formed straight in the span that the slider 44 descends from the uppermost position as shown in FIG. 7*a* to the middle position as shown in FIG. 7*b* such that the pivotal shaft 43 may not be turned.

The slider 44 is also provided with another straight slit 44*c* formed avoiding the portion where the spiral slit 44*b* is formed, and further a recess 44*d* is provided at a proper portion of the slider 44 to communicate with the lower end of the slit 44*c*. The recess 44*d* and the straight slit 44*c*, as described later, function to allow one end of a connecting member 47, operatively connected to a biasing member 46 which release the press contact between the tension discs 23, 24, to rest therein and to hold the connecting member 47 at a predetermined tilting posture.

Further, the sewing machine according to this embodiment is provided with a threading device as described above. Accordingly, the slider 44 is connected to a slider 49 of the threading device 48 through a second connecting piece 44*e* protruding from the slider 44 to achieve at one time, by pushing down the operating member 36, a series of the following operations:

(1) to release press contact between the thread tension regulator 13;

(2) to draw out the upper thread 10 through horizontal turning of the actuating member 31; and (3) to thread the upper thread 10 automatically into the thread eye 17 of the needle 16.

Figure 7A:
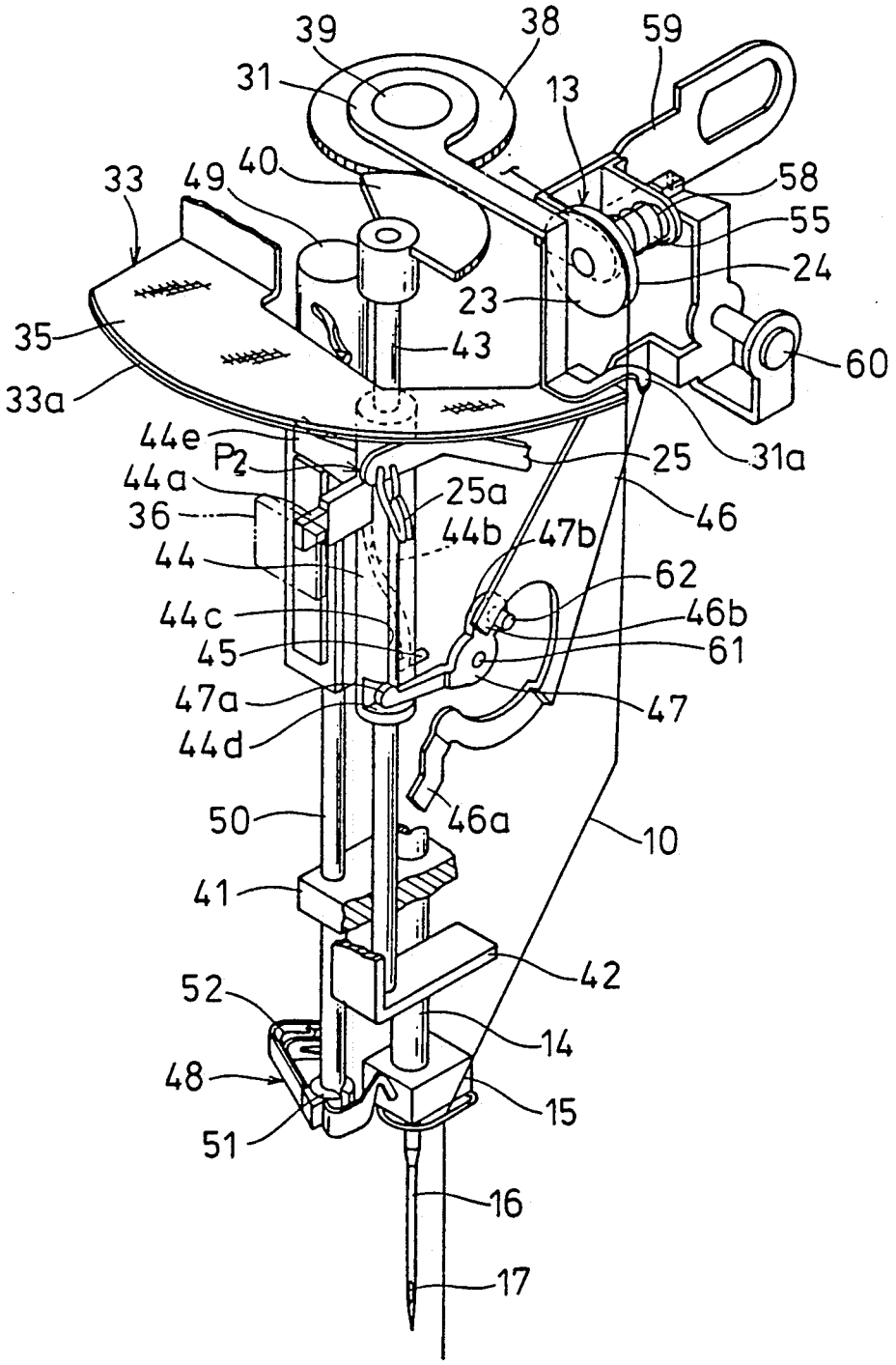

The threading device 48 to be employed in this embodiment is of a known mechanism, and for example, a device described in the Japanese Utility Model Publication No. 43878/1979 of the assignee of the present application may suitably be employed. Accordingly, in this specification, detailed description on the threading device 48 itself has been omitted, instead, only the part name is mentioned. Namely, in FIG. 4, the numeral 50 indicates a threading bar; 51 a cylindrical member provided at the lower end of the threading bar 50; 52 a threading hook mounted to the cylindrical member 51; and 53 a tension spring which constantly forces to pull upward the slider 49, respectively. However, when the threading device 48 is not attached to a sewing machine, an additional tension spring will be necessary to pull up the slider 44 to the uppermost position which is intended for urging the actuating member 31 to turn, and hold the slider 44 in a state as shown in FIG. 7*a*.

The sector form gear 40 and the gear 38 are set to provide optimal engagement such that the hook-shaped transfer body 31*a* of the actuating member 31, in a state where the slider 44 is pulled up to the uppermost position, can be located in the slot 32 provided in the defining plate 11 as shown in FIG. 1 to wait to catch the upper thread 10 extending along the thread guiding path. The turning angle of the actuating member 31 is set at an optimal degree such that the amount of the upper thread 10 to be drawn out by the transfer body 31*a* in a state where the actuating member 31 has turned to the maximum level may correspond to the amount of thread to be taken up by the thread take-up lever 25.

Press Contact Relating Member for Thread Tension Regulator

The thread tension regulator 13 is located in the groove at the right shoulder of the defining plate 11 as shown in FIGS. 1 and 3, and comprises a pair of tension discs 23, 24 and tension regulating spring 58 fitted around a support shaft 55 mounted horizontally to a support plate 54 and is adapted to impart appropriate tension to the upper thread 10 passing between the two tension discs 23, 24. As disclosed in the Japanese Utility Model Publication No. 120166/1981 filed by the assignee of the present application, the thread tension regulator 13 has a construction wherein a pressure releasing member 59 of a required shape is further supported around the support shaft 55, and by lifting the knee lifter lifting lever 21 to lift the presser foot 19 prior to starting sewing operation, the pressure releasing member 59 releases the stress of the tension regulating member 58 interlocking with the lifting of the lever to facilitate insertion of the upper thread 10 between the tension discs 23, 24.

Referring now to the sewing machine according to this embodiment, the resilience of the tension regulating spring 58 of the thread tension regulator 13 has to be moderated also when the actuating member 31 is turned horizontally by pushing the operating member 36 as described later with a required angle, to catch the upper thread 10 extending along the thread guiding path and draw out a predetermined amount thereof such that the upper thread 10 may be fed smoothly through the two tension discs 23, 24 with the upper thread 10 not being subjected to press contact therebetween. For this purpose, the thread tension regulator 13 is incorporated with an interlocking mechanism which interlocks with the operation to descend the operating member 36 and releases the press contact between two tension discs 23, 24 prior to the catching and drawing out of the upper thread 10 by the actuating member 31 as well as the mechanism described above which interlocks with the lifting operation of the knee lifter lifting lever 21 to release pressure between the two tension discs 23, 24.

Figure 5:
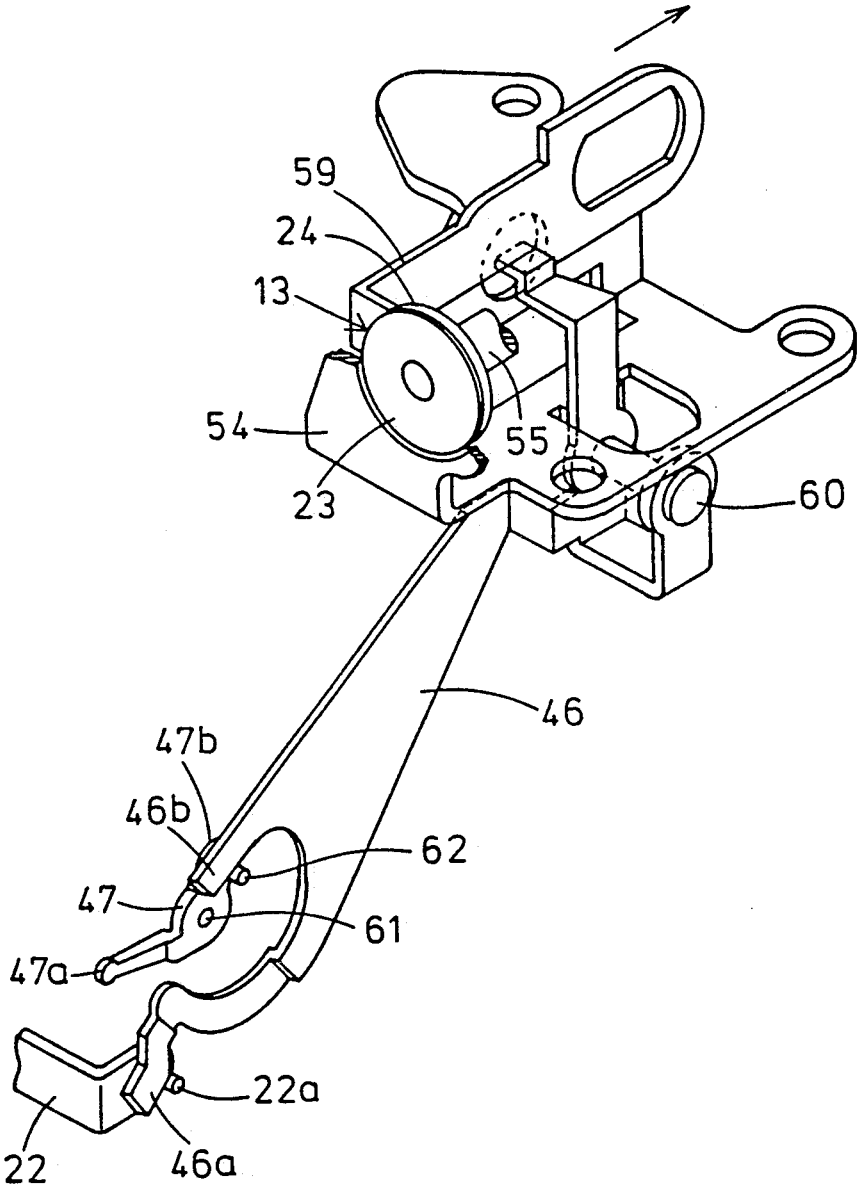
FIG. 5 is a perspective view showing schematically the structure of the means for releasing press contact between the tension discs of the thread tension regulator and its cooperative relationship.
Figure 6:
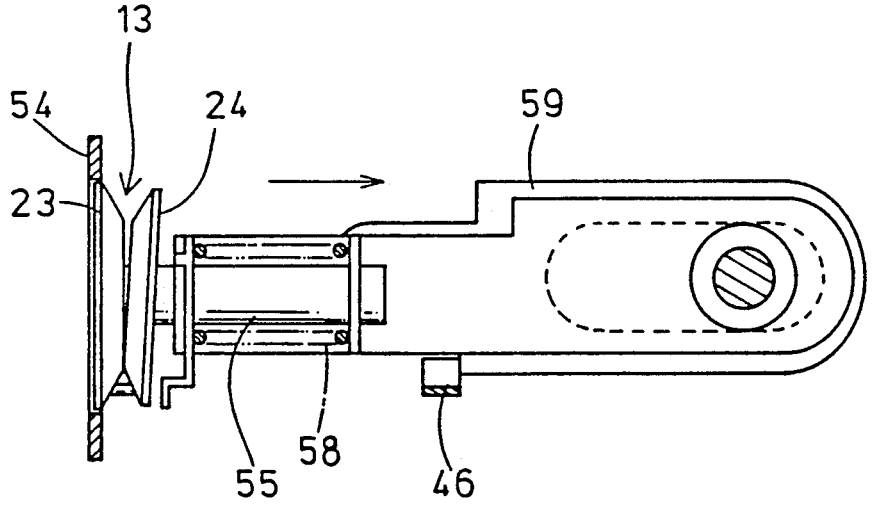
FIG. 6 is an enlarged view of the two tension discs of the thread tension regulator whose press contact is released.

As shown in FIG. 6, for example, the pressure releasing member 59 provided in the thread tension regulator 13 is supported around the support shaft 55 and interposed between one tension disc 24 and the tension regulating spring 58 such that the pressure releasing member 59 can be moved longitudinally with respect to the shaft 55. Also a lever-shaped biasing member 46 as shown in FIGS. 3 and 5 is pivotally supported on the main frame 1 through a shaft 60, and one end of the biasing member 46 is relatively connected to the pressure releasing member 59. If the biasing member 46 is oscillated clockwise around the shaft 60, the pressure releasing member 59 is forced to move in the direction to release stress of the tension regulating spring 58. The other end of the biasing member 46 is branched into two portions. A first branch piece 46*a* is engageable with the pin 22*a* of the link member 22 constituting a part of the presser bar lifter 20, and causes the biasing member 46 to oscillate clockwise and to actuate the pressure releasing member 59.

A second branch piece 46*b* of the biasing member 46 in turn is operatively connected to the slider 44, which turns the actuating member 31, by means of the connecting member 47 to interlock with the operation of the operating member 36 to permit actuation of the pressure releasing member 59.

Figure 7B:
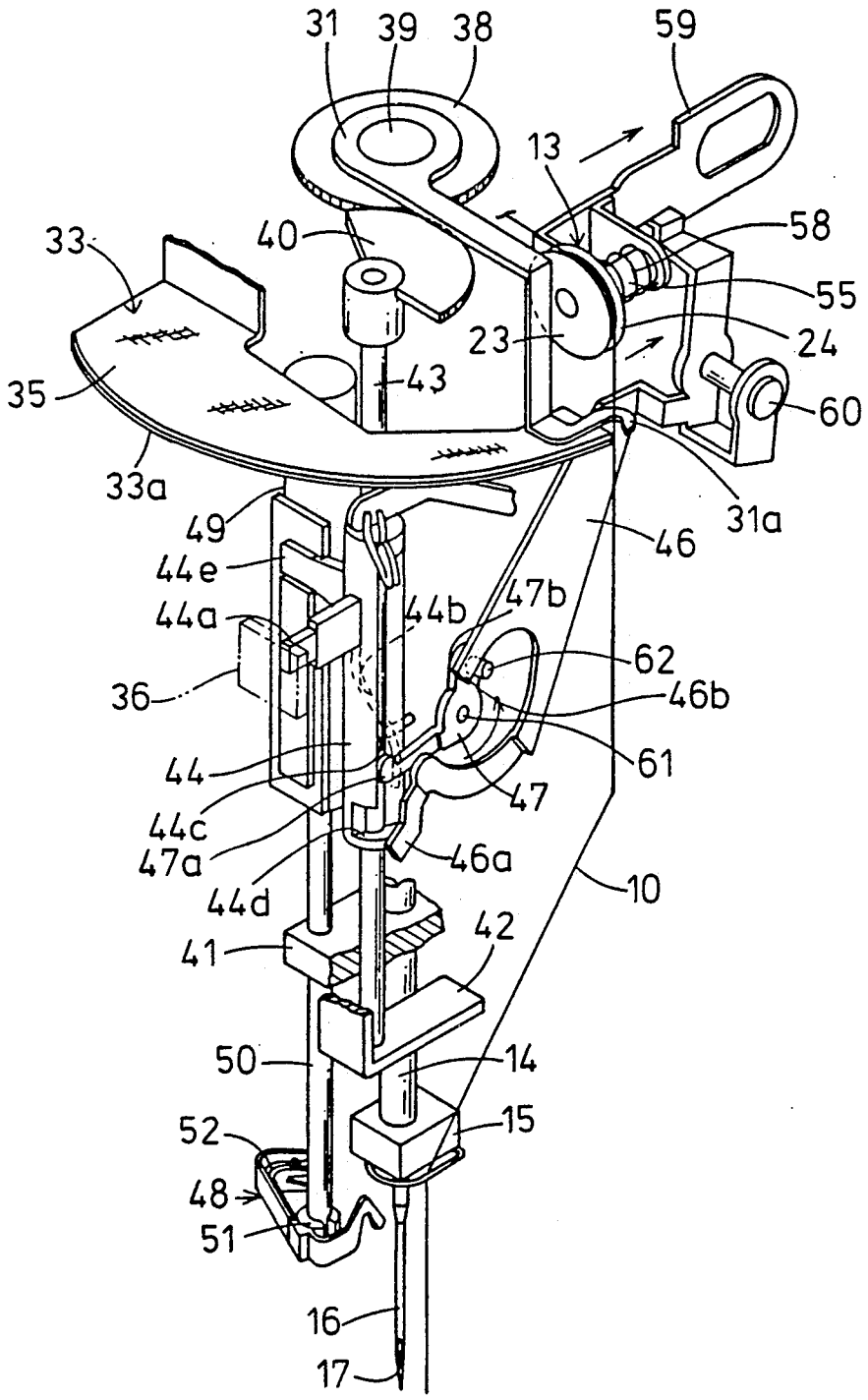
Figure 7C:
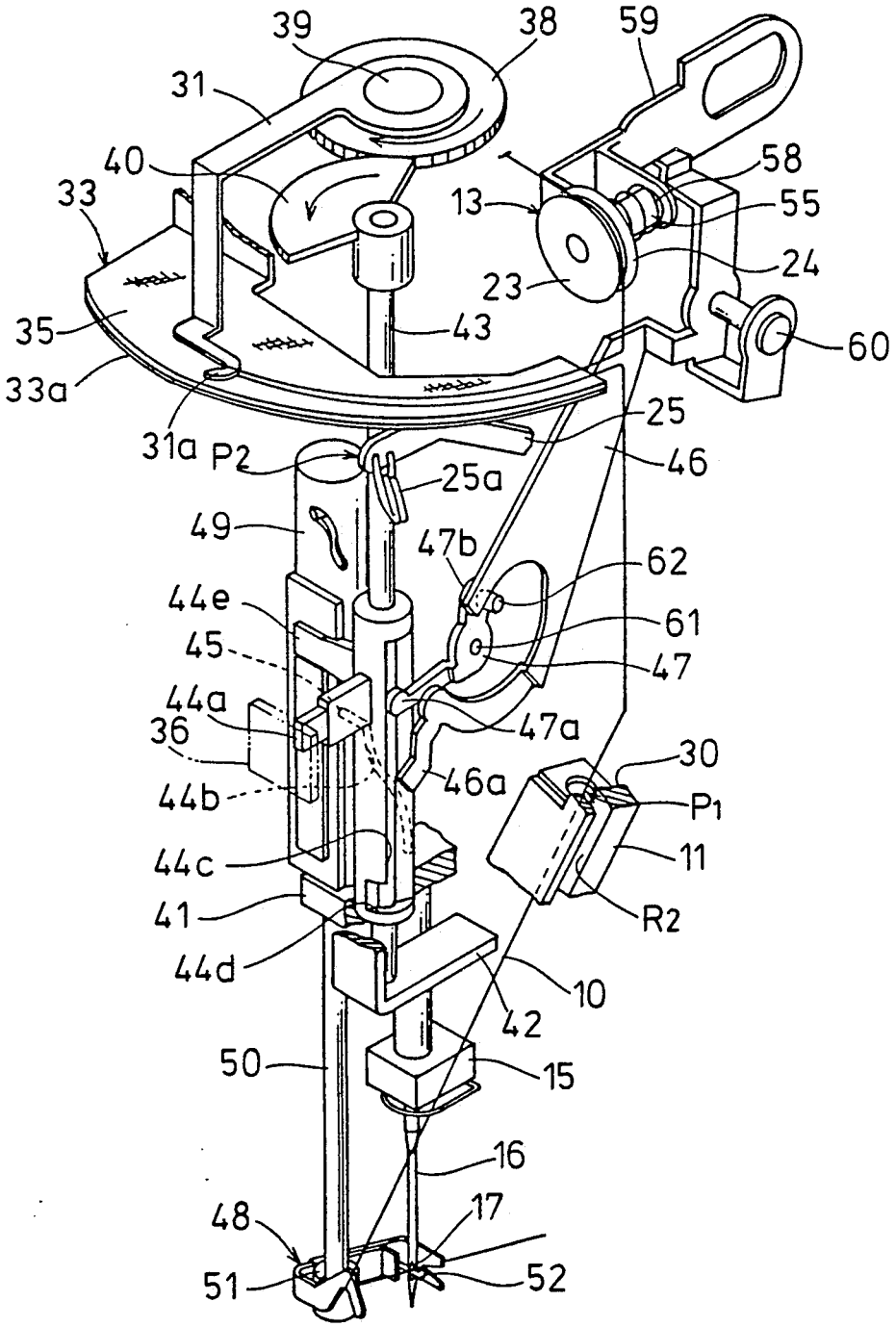
Figure 7D:
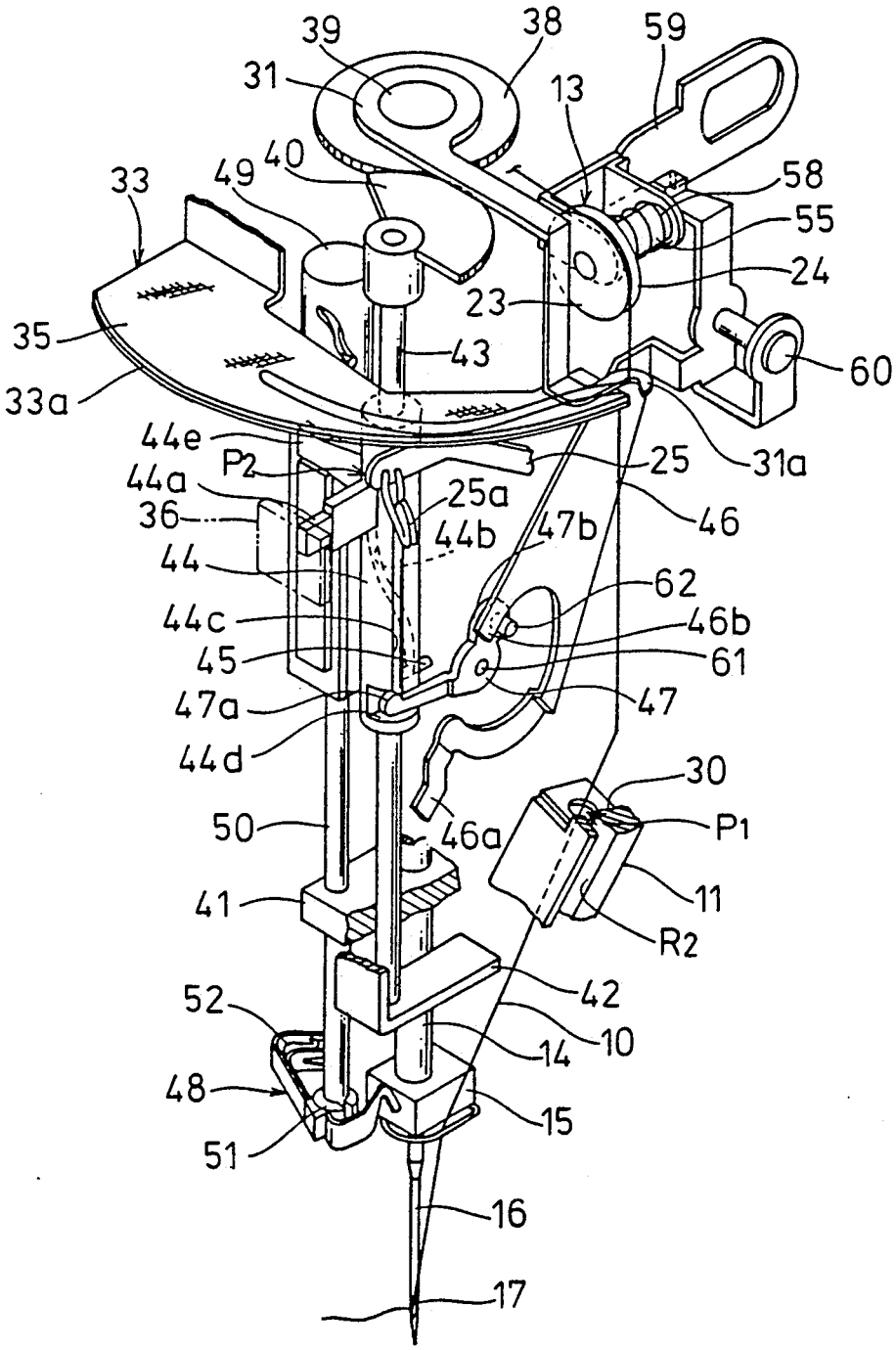

Namely, the connecting member 47 is pivotally supported by a shaft 61 onto the supporting piece 42*b* branched from the shaft supporting frame 42, and the tip of the first arm 47*a* of the connecting member 47 is allowed to rest in the recess 44*d* formed in the slider 44 and the second arm 47*b* is adapted to be engageable with the second branch piece 46*b* of the biasing member 46 through a pin 62 protruding from the second arm. Accordingly, prior to the operation of the operating member 36, as shown in FIG. 7*a*, the first arm 47*a* of the connecting member 47 is resting in the recess 44*d*, and the pin 62 is spaced away from the second branch piece 46*b* under the action of the tension spring 53 to pull up the slider 44 with no operative connection with the biasing member 46. Therefore, by pushing down the operating member 36 to effect descending thereof as shown in FIG. 7*b* the first arm 47*a* of the connecting member 47 is forced to retract from the recess 44*d*, and subsequently to be transferred to the straight slit 44*c*. Thus, the connecting member 47 oscillates counterclockwise around the shaft 61 to cause the pin 62 of the second arm 47*b* to engage the second branch piece 46*b* of the biasing member 46 to effect operative connection therebetween. As the result of the connection, the biasing member 46 oscillates clockwise around the shaft 60 to transfer the pressure releasing member 59 in the longitudinal direction of the support shaft 55 to release press contact between the two tension discs 23, 24. However, while the operating member 36 further descends as shown in FIG. 7*c*, the oscillation posture of the connecting member 47 may be maintained as it should be, since the straight slit 44*c* of the slider 44 is moved abutting against the tip of the first arm 47*a* of the connecting member 47, thereby the press contact between the tension discs 23, 24 is still in the released state.

Operation of the Embodiment

Next, description will be made on the operation of the thread securing device according to the thus constructed embodiment to be involved in the actual operation thereof. It should be assumed that the power switch (not shown) of the sewing machine is turned on and that the hooking of the upper thread into the thread take-up lever 25 has not yet been effected. In a state prior to sewing operation, as shown in FIGS. 1 and 7*a*, the transfer body 31*a* provided at the tip of the actuating member 31 is located in the slot 32 to wait to catch the upper thread 10; and the tip of the first arm 47*a* of the connecting member 47 is resting in the recess 44*d* of the slider 44 to maintain the two tension discs 23, 24 in press contact. However, the thread take-up lever 25 is not necessarily required to be waiting at the uppermost position, but may locate at any optional position where it stopped after the completion of the previous sewing operation of the sewing machine.

In providing for sewing operation of the sewing machine, the upper thread 10 is first drawn out of the spool 8 and inserted through the thread guiding path to be defined as the vertical groove R1 of the defining plate 11. By pushing down vertically the operating member 36 provided on the left side of the head 5 after drawing out the upper thread 10 up to above the two tension discs 23, 24 being kept in press contact, the slider 44 connected through the connecting piece 44*a* to the operating member 36 starts to descend guided by the guide slit 42*a* of the shaft supporting frame 42. The descending of the slider 44 forces the first arm 47*a* of the connecting member 47 to retract from the recess 44*d* as shown in FIG. 7*b*, and thereby the connecting member 47 oscillates counterclockwise around the shaft 61 and the pin 62 protruding from the second arm 47*b* presses the second branch piece 46*b* of the biasing member 46. The biasing member 46 is thus caused to oscillate clockwise around the shaft 60 to transfer the pressure releasing member 59 along the support shaft 55 and thereby the tension regulating spring 58 is loosened to release the press contact between the two tension discs 23, 24.

Such releasing of the press contact facilitates reception of the upper thread 10 between the two tension discs 23, 24. Then an operator guides the upper thread 10 downward along thread guiding path in the vertical groove R2 provided in the vertically extending portion 11*b* of the defining plate 11, through the bent portion to the vicinity of the thread eye 17 of the needle 16. Thus, the upper thread 10 extending in the vertical groove R2 of the defining plate 11 assumes a posture to pass nearby said slot 32 provided in said defining plate 11 and the recess 30 located at the thread loosening position P1.

Also in a state shown in FIG. 7*b*, the spiral starting end of the spiral slit 44*b* of the slider 44 has not reached the pin 45 of the pivot 43 as described above, but the straight portion of the slit remains with the pin 45. Accordingly, the pivotal shaft 43 has not yet been imparted with pivotal movement, and the actuating member 31 remains still. Further, in a known threading device 48 connected to the slider 44 through the first connecting piece 44*e*, although the threading bar 50 is allowed to descend directly to transfer the hook 52 toward the thread eye 17 of the needle 16, turning of the cylindrical member 51 has not yet been achieved.

When the operating member 36 is further pushed downward continuously to effect descending thereof, the spiral starting end of the spiral slit 44*b* of the slider 44 approaches the pin 45 provided in the pivotal shaft 43 as shown in FIG. 7*c*. The pivotal shaft 43 is turned counterclockwise through the pin 45, and the gear 38 engaged by the sector form gear 40 is turned clockwise. The actuating member 31 is thus turned horizontally with the required central angle above the mat of the thread saving member 33. The transfer body 31*a* which was located in the slot 32 of the defining plate 11 immediately before the turning catches the upper thread 10 extending along the thread guiding path as the turning is started and draw out a sufficient amount of the thread above the thread saving member 33. As described above, the turning level of the actuating member 31 has preliminarily been set at a proper degree such that the amount of the upper thread 10 to be drawn out may correspond with the predetermined amount of the upper thread 10 to be taken up by the thread take-up lever 25 during its travel from the thread loosening position Pl to the thread take-up position P2.

Since the press contact between the two tension discs 23, 24 is released during the operation of the actuating member 31 as mentioned above, the upper thread 10 may be drawn out very smoothly from the spool 8 through the thread tension regulator 13. Also, the threading bar 50 of the threading device 48 starts to turn to effect insertion of the hook 52 provided in the cylindrical member 51 into the thread eye 17 of the needle 16, then the operator may apply the upper thread 10 to the hook 52 extending through the thread eye 17. When the upper thread 10 is applied to the hook 52, an appropriate tension may conveniently be imparted to the former. In this embodiment, the upper thread 10 is adapted to be imparted with an appropriate tension at the bent portion of the thread guiding path even when the press contact between the tension discs 23, 24 is released.

When the pushing force is then removed from the operating member 36, the slider 44 (and slider 49) ascends under the resilient resetting action of the tension spring 53, during which the pivotal shaft 43 is turned reversely, i.e., clockwise, by the spiral slit 44*b* through the pin 45. The actuating member 31 is also turned counterclockwise, and the transfer body 31*a* releases the upper thread 10 and will be again projected in the slot 32 of said defining plate 11 to make a stop therein (FIG. 1). Thus, a required amount of the upper thread 10 can be saved on the upper surface of the mat 35 of the thread saving member 33.

The slider 49 of the threading device 48 ascends interlocking with the ascending of the operating member 36 upon removal of the pressing force and causes the threading bar 50 to turn reversely, thereby the threading hook 52 positively catches the upper thread 10 applied thereto to achieve threading into the thread eye 17 of the needle 16. In this process, since the portion of the straight slit 44*c* formed in the slider 44 is in sliding abutment against the tip of the first arm 47*a* of said connecting member 47 across the ascending stroke of said slider 44 operatively connected to the connecting member 47, the oscillating posture of the connecting member 47 is still maintained, with the press contact between the two tension discs 23, 24 remaining in a released state. Accordingly, the operator need not take the trouble to loosen the upper thread 10, because no tension is imparted to the upper thread 10 by the thread tension regulator 13 while the threading hook 52 is being withdrawn from the thread eye 17 of the needle 16.

As the slider 44 further ascends, the recess 44*d* of the slider 44 returns to the first arm 47*a* of the connecting member 47 to cause the connecting member 47 to oscillate, and the pin 62 protruding from the second arm 47*b* of the connecting member 47 is released from the second branch piece 47*b* of the biasing member 46. Thus, the force applied to the pressure releasing member 59 is removed, and the two tension discs 23, 24 of the thread tension regulator 13 can assume a posture capable of holding the upper thread 10 under press contact to impart tension thereto.

Figure 7E:
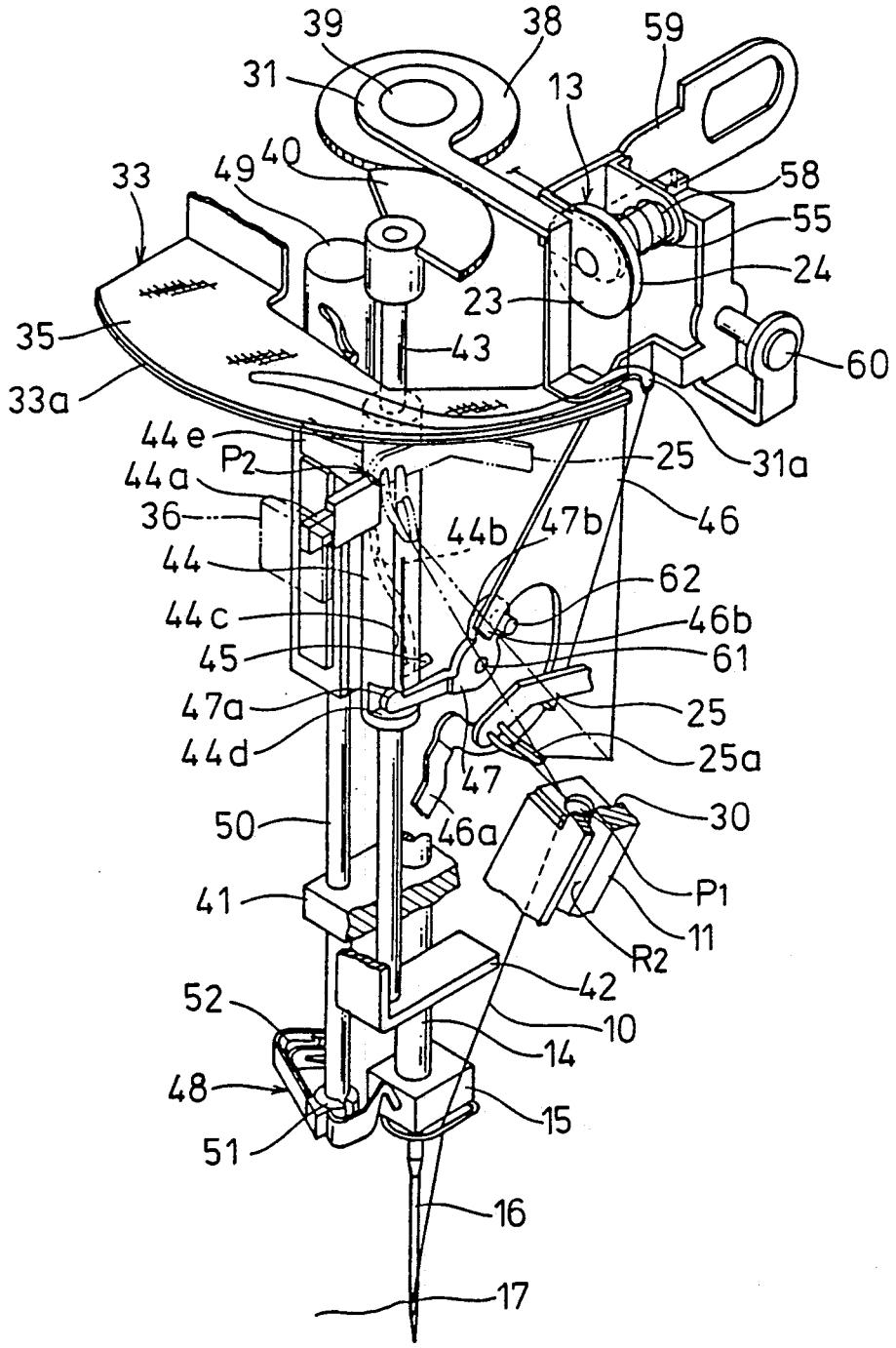

Thus, when the start/stop switch (not shown) of the sewing machine is turned on under the state where a required amount of the upper thread 10 is saved over the thread saving member 33, the main motor (not shown) rotates to drive the main shaft 27, thereby to enable sewing of fabric to be processed by moving the needle bar 14 vertically. The cylindrical cam 26 is also rotated simultaneously to impart vertical arcuate movement to the thread take-up lever 25 through the cam follower 29 located in the cam groove 26*a* (FIG. 8). This movement will cause the thread holding end 25*a* of the thread take-up lever 25 to move between the thread loosening position P1 in the recess 30 provided in the defining plate 11 and adjacent to the thread guiding path and the thread take-up position P2 in the lower part of the thread saving member 33 as described above in timed relation to the vertical movement of the needle bar 14. When the thread holding end 25*a* of the thread take-up lever 25 first reaches the thread loosening position P1 in the recess 30 after starting up of the sewing machine and start traveling to the thread take-up position P2, the thread holding end 15*a* catches the upper thread 10 as shown in FIG. 7*e*. In the process of the thread holding end 25*a* traveling to the thread take-up position P2, the upper thread 10 saved over the thread saving member 33 is fed freely in accordance with the thread take-up action of the thread take-up lever 25, to achieve holding of the thread by the thread take-up lever 25. In the above process, the upper thread 10 having been threaded into the thread eye 17 of the needle 16 never retracts to slip off therefrom, since an amount of the upper thread 10 corresponding to the thread take-up amount to be taken up by the thread take-up lever 25 is to be fed.

Embodiment Not Provided with Threading Device

The sewing machine according to the embodiment shown in FIGS. 1 to 8 is provided with a threading device 48 of a known mechanism as an accessory, which permits the operator to visually confirm if the upper thread 10 is held by the thread holding end 25*a* of the thread take-up lever 25 in preparation for the sewing operation. Therefore, in a sewing machine not provided with a threading device 48 (also in a sewing machine provided with a threading device but not interlocked with the actuating member), means for detecting if the upper thread 10 is held at the thread holding end of the thread take-up lever 25 is required. Thus, FIGS. 9 to 12 show another embodiment of a device wherein a predetermined amount of the upper thread 10 may be saved over the thread saving member 33 by automatically actuating the actuating member 31 after detection of the fact that the upper thread 10 is not being held by the thread take-up lever 25. The basic mechanism and mechanical function of this device are identical with those of the embodiment illustrated referring to FIGS. 1 to 8; therefore, only mechanical parts different therefrom and control circuit will be described.

As shown in FIG. 9, a rack 44*f* is formed in the slider 44 to be fitted around the pivotal shaft 43, to be integral therewith, and the rack 44*f* is inserted in the guide slit 42*a* provided in the shaft supporting frame 42 and extends outward therefrom. A motor supporting chip 42*c* is formed on the shaft supporting frame 42, and a pulse motor 63 which functions as an electromagnetic actuator is mounted to the supporting chip 42*c*. The pinion 65 fixed to the rotary shaft 64 engages the rack 44*f*. The actuating member 31 is adapted to be imparted with a horizontal movement both clockwise and counterclockwise by ascending or descending the slider 44 through rotation of the pulse motor 63.

A detector 66 is provided adjacent to the thread guiding path in the vertical groove R2 below the recess 30 formed in the vertically extending portion 11*b* of the defining plate 11 as shown in FIG. 10, which is capable of detecting if the thread take-up lever 25 is holding the upper thread 10 or not. Namely, the detector 66 comprises a microswitch which facilitates switching action with application of a light pressing power, and its switch lever 66*a* is arranged in a relationship where it crosses with the vertical groove R2 of the defining plate 11. By the passing action of the upper thread 10 when the operator inserts the upper thread 10 along the vertical groove R2, the switch lever 66*a* is pushed, energizing the switch to be turned on. An example of the electric control circuit of the sewing machine which utilizes detector 66 and the pulse motor 63 is shown in a block chart in FIG. 11. The start/stop switch (not shown) and the detector switch 66 which detects if the thread is inserted or not are connected to a central processing unit (CPU) 70 which is exclusively used for controlling motors, and from the CPU 70 control command is delivered through a pulse motor driver 71 to the pulse motor 63 and also to a known main motor through a main motor driver 72.

The actions of the sewing machine according to the embodiment thus constructed may be described below referring to the flow chart shown in FIG. 12. By turning on the power switch of the sewing machine, the pulse motor 63 rotates reversely in step S1 to contact the zero position stopper not shown and stops to effect zero position setting. In step S2, a timer is set to give a required timing. In step S3, it is determined if the timer has completed the required length of timing operation or not; if it has been determined that the time is up (YES), it is then determined in step S4 if the start/stop switch is turned on; and if it has been determined that the switch is turned on, pass is made to step S9 and the main motor is driven there.

Alternatively, when it has been determined that the timer has not completed the timing operation (NO) in step S3, pass is made to step S5 and there it is determined if the detector switch 66 is turned on or not. When the upper thread 10 is inserted along the thread guiding path as shown in FIG. 10 and the detector switch 66 is turned on, the driver 71 causes normal rotation of the pulse motor 63 by the predetermined number of steps in step S6. Thereby the slider 44 descends by the required strokes and the actuating member 31 operates accompanied with a series of actions to effect saving of the upper thread 10 in a required amount over the thread saving member 33 as shown in FIG. 7*c*. The process then proceeds to step S7, where it is determined if the start/stop switch is turned on or not; when it is determined to be YES the pulse motor 63 is subjected to reverse rotation by the predetermined number of steps to return the actuating member 31 to the original position in step S8, and then the main motor is driven in step S9 to effect catching of the upper thread 10 by thread take-up lever 25. When the start/-stop switch is turned off in step S10 at the end of the required sewing operation, the main motor is stopped in step S11 to complete a series of sewing operation.

As has been described in detail heretofore, the thread securing device according to this invention has been constructed such that amount of the upper thread corresponding to the take-up amount to be taken up by the thread take-up lever may be saved preliminarily and the saved amount of the upper thread may be fed freely in accordance with the thread take-up movement of the thread take-up member, in a sewing machine wherein the upper thread located along the thread guiding path is caught by the thread take-up member during its travel to effect automatic holding of the upper thread by the thread take-up member. Accordingly, slipping off of the upper thread having been threaded into the thread eye of the needle from the thread eye during the automatic thread hooking operation of the thread take-up member upon starting up of the sewing machine may effectively be prevented.

Accordingly, the operations in preparation for the sewing operation in a sewing machine may considerably be simplified, since the thread securing device of the invention obviates complicated handling, such as the manual operation of threading the upper thread again into the thread eye after slipping off of the upper thread has occurred, or a care to pull out a sufficient amount of thread extending out of the needle preliminarily with a view to prevent such a slipping off of the upper thread.

While the invention has been described with reference to preferred embodiments thereof, it is to be understood that modifications and variations may be easily made without departing from the spirit of this invention which is defined by the appended claims.

What is claimed is:

1. A thread securing device in a sewing machine having a thread source, a needle having a thread eye for carrying an upper thread extending from said thread source, a thread take-up member adapted to move in timed relation to the vertical movement of said needle between a thread loosening position close to a predetermined thread guiding path extending from said thread source to said thread eye of said needle and a thread take-up position spaced away from said thread guiding path, the thread take-up member being operative to catch and hold the upper thread extending along the thread guiding path when said thread take-up member first approaches in the vicinity of the thread loosening position, said thread securing device comprising:

thread saving means having a thread saving plate extending horizontally from said thread guiding path, said thread saving plate being capable of saving an amount of the upper thread corresponding to a predetermined amount of the upper thread to be taken up by said thread take-up member during its movement from the thread loosening position to the thread take-up position and capable of feeding the saved amount of the upper thread freely in accordance with the thread take-up movement of the thread take-up member; and actuating means adapted to catch the upper thread extending along said thread guiding path when said thread takeup member is not holding the upper thread and then supply an amount of the upper thread corresponding to said predetermined amount to said thread saving means.

2. The thread securing device in a sewing machine according to claim 1, wherein said actuating means operates in interlocking relation to the threading action of a threading device adapted for threading the upper thread into the thread eye of the needle.

3. The thread securing device in a sewing machine according to claim 1, wherein a thread tension regulating means provided in said thread guiding path is capable of releasing the upper thread when said actuating means is energized.

* * * * *